US009573397B1

(12) United States Patent
Ito et al.

(10) Patent No.: US 9,573,397 B1
(45) Date of Patent: Feb. 21, 2017

(54) INK-JET RECORDING APPARATUS

(71) Applicant: Brother Kogyo Kabushiki Kaisha, Nagoya-shi, Aichi-ken (JP)

(72) Inventors: Tsuyoshi Ito, Nagoya (JP); Iwane Sano, Obu (JP); Gakuro Kanazawa, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/083,740

(22) Filed: Mar. 29, 2016

(30) Foreign Application Priority Data

Sep. 30, 2015 (JP) ..... 2015-195356

(51) Int. Cl.

| | |
|---|---|
| ***B41J 29/38*** | (2006.01) |
| ***B41J 13/036*** | (2006.01) |
| ***B41J 11/00*** | (2006.01) |
| ***B41J 2/21*** | (2006.01) |
| ***B41J 2/045*** | (2006.01) |
| ***B41J 13/14*** | (2006.01) |
| ***B41J 13/00*** | (2006.01) |
| ***B41J 11/42*** | (2006.01) |

(52) U.S. Cl.
CPC ..... *B41J 13/036* (2013.01); *B41J 2/04573* (2013.01); *B41J 2/2132* (2013.01); *B41J 11/005* (2013.01); *B41J 11/0005* (2013.01); *B41J 11/42* (2013.01); *B41J 13/0027* (2013.01); *B41J 13/14* (2013.01)

(58) Field of Classification Search
CPC ... B41J 2/04573; B41J 2/2132; B41J 11/0005; B41J 11/005; B41J 13/14; B41J 11/42; B41J 13/0027; B41J 13/036
See application file for complete search history.

(56) References Cited

FOREIGN PATENT DOCUMENTS

JP H11-138923 A 5/1999

*Primary Examiner* — Julian Huffman
(74) *Attorney, Agent, or Firm* — Banner & Witcoff, Ltd.

(57) ABSTRACT

An ink-jet recording apparatus includes: a conveyance unit; a support part including ribs; a recording head; a carriage carrying the recording head; a detecting unit configured to detect a position of the sheet conveyed; and a controller. In a case that the sheet supported by the support part is in a position in which the sheet is nipped by the conveyance unit, the controller is configured to shift nozzles, from which ink droplets are jetted to a center area of an upper surface of the support part in the width direction, to an upstream or a downstream in the conveyance direction by a predetermined number relative to nozzles from which ink droplets are jetted to outer areas positioned outside the center area in the width direction.

8 Claims, 12 Drawing Sheets

INK-JET RECORDING APPARATUS

CROSS REFERENCE TO RELATED APPLICATION

The present application claims priority from Japanese Patent Application No. 2015-195356 filed on Sep. 30, 2015, the disclosure of which is incorporated herein by reference in the entirety.

BACKGROUND

Field of the Invention

The present invention relates to an ink-jet recording apparatus configured to record an image on a sheet by jetting ink from nozzles.

Description of the Related Art

There are conventionally known ink-jet recording apparatuses configured to record an image on a sheet by jetting ink from nozzles provided in a recording unit. In the ink-jet recording apparatus, a sheet being conveyed in the apparatus may float from a platen supporting the sheet. When the sheet floats from the platen at a position facing the recording unit, a space or interval between the sheet and the recording unit varies and quality of an image to be recorded on the sheet may be affected thereby.

To solve the above problem, there are known recording apparatuses in which a sheet placed on a platen is made to have a waved shape along a width direction orthogonal to a conveyance direction. For example, in a known recording apparatus, ribs are provided in the platen at intervals along the width direction and holding members holding the sheet from above are disposed between the ribs in the width direction. This configuration waves the sheet in the width direction.

SUMMARY

The above recording apparatus, however, may have the following problem. Namely, when the sheet is made to have the waved shape in a state that the sheet is nipped by a resist roller pair disposed on the upstream side of the platen in the conveyance direction and that the downstream end of the sheet in the conveyance direction does not reach a discharge roller pair disposed on the downstream side of the platen in the conveyance direction, the downstream end of the sheet in the conveyance direction comes closer to the center in the width direction. Thus, the distance, between the nip position of the sheet by the resist roller pair and the downstream end of the sheet in the conveyance direction, at the center in the width direction is shorter than the distance therebetween at both ends in the width direction. When an image is recorded on the sheet in this situation, the image recorded on the sheet twists or gets distorted along the width direction.

The same problem as above may occur in a state that the sheet is nipped by the discharge roller pair and that the upstream end of the sheet in the conveyance direction has passed the resist roller pair. Further, even when the recording apparatus has no holding members, parts, of the sheet, between adjacent ribs sink under the weight of the ink permeating the sheet. This waves the sheet in the width direction, and thus the same problem as above may occur.

The present teaching has been made in view of the above circumstances, and an object of the present teaching is to provide an ink-jet recording apparatus which reduces deterioration in quality of an image to be recorded on a sheet made to have a waved shape.

According to an aspect of the present teaching, there is provided an ink-jet recording apparatus configured to jet droplets of ink on a sheet, including:

a conveyance unit configured to convey the sheet in a conveyance direction while nipping the sheet;

a support part including ribs, which extend in the conveyance direction and are disposed at intervals in a width direction intersecting with the conveyance direction, and being configured to support the sheet conveyed in the conveyance direction;

a recording head disposed to face the support part, including nozzles disposed to be aligned in the conveyance direction, and being configured to jet ink droplets from the nozzles to the support part, a carriage carrying the recording head and being configured to move in the width direction intersecting with the conveyance direction;

a detecting unit configured to detect a position of the sheet conveyed; and a controller configured to control the conveyance unit to repeat conveyance of the sheet and stop of the conveyance of the sheet alternately and to control the recording head to perform recording in which ink droplets are jetted from the nozzles during movement of the carriage with the conveyance of the sheet being stopped, wherein, in a case that the sheet supported by the support part is in a position in which the sheet is nipped by the conveyance unit, the controller is configured to shift nozzles, from which ink droplets are jetted to a center area of an upper surface of the support part in the width direction, to an upstream side or a downstream side in the conveyance direction by a predetermined number relative to nozzles from which ink droplets are jetted to outer areas, of the upper surface of the support part, positioned outside the center area in the width direction.

In the above configuration, the controller shifts nozzles relative to the sheet which is made to wave in the width direction. This reduces twist or distortion of an image to be recorded on the sheet. Thus, it is possible to reduce deterioration in quality of the image to be recorded on the sheet.

BRIEF DESCRIPTION OF THE DRAWINGS

FIGS. 10A to 10C each schematically depict a recording unit 24, the platen 42, a conveyance roller 60, a discharge roller 62, and the sheet 12, wherein FIG. 10A is a plan view depicting a state in which image recording is performed at the front end of the sheet 12 without shifts of nozzles 39, FIG. 10B is a plan view depicting a state in which image recording is performed at the front end of the sheet 12 with shifts of nozzles 39, and FIG. 10C depicts a state in which image recording is performed at the rear end of the sheet 12 with shifts of nozzles 39.

DESCRIPTION OF THE EMBODIMENTS

Figure 1:
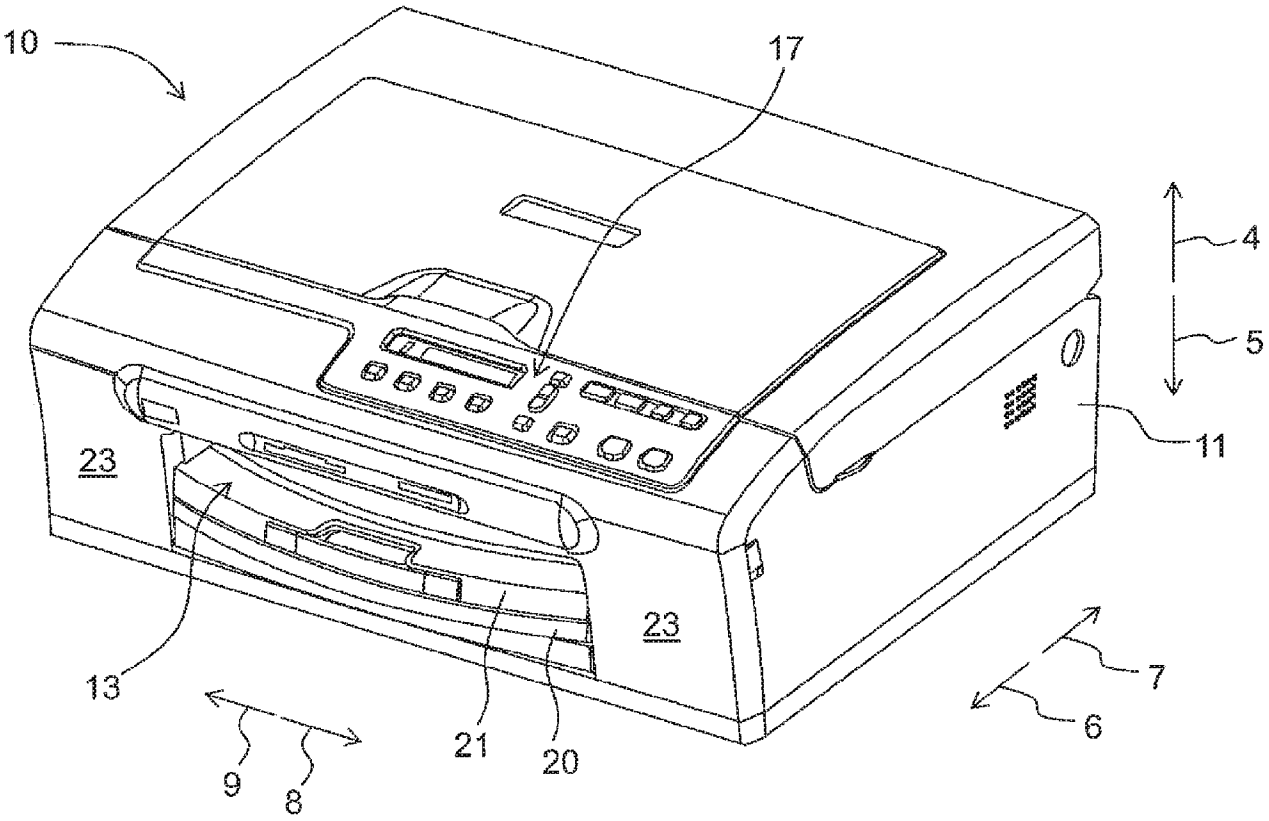
FIG. 1 is a perspective view of a multifunction peripheral 10 according to an embodiment of the present teaching.

In the following, an explanation will be made about an embodiment of the present teaching. It is needless to say that the embodiment to be explained below is merely an example of the present teaching, and it is possible to appropriately change the embodiment of the present teaching without departing from the gist and scope of the present teaching. In the following explanation, an upper direction 4 and a lower direction 5 are defined based on the state in which a multifunction peripheral 10 is placed to be usable (the state depicted in FIG. 1). A front direction 6 and a rear direction 7 are defined as a surface of the multifunction peripheral 10 in which an opening 13 is provided is regarded as a front surface 23. A right direction 8 and a left direction 9 are defined as the multifunction peripheral 10 is viewed in the rear direction 7. The upper direction 4 is a direction opposite to the lower direction 5. The right direction 8 is a direction opposite to the left direction 9. The upper direction 4 is perpendicular to the front direction 6 and the right direction 8, and the front direction 6 is orthogonal to the right direction 8.

<Entire Structure of Multifunction Peripheral 10>

As depicted in FIG. 1, the multifunction peripheral 10 (an exemplary ink-jet recording apparatus) is formed to have a substantially rectangular parallelepiped shape of a thin type. A printer unit 11 is provided at a lower part of the multifunction peripheral 10. The multifunction peripheral 10 has various functions such as a facsimile function and a print function. As the print function, the multifunction peripheral 10 has a function of recording an image on one surface of a sheet 12 (see FIG. 2, an exemplary sheet) by an ink-jet recording system. Note that the multifunction peripheral 10 may have a function of recording images on both surfaces of the sheet 12.

<Feed Tray 20>

Figure 2:
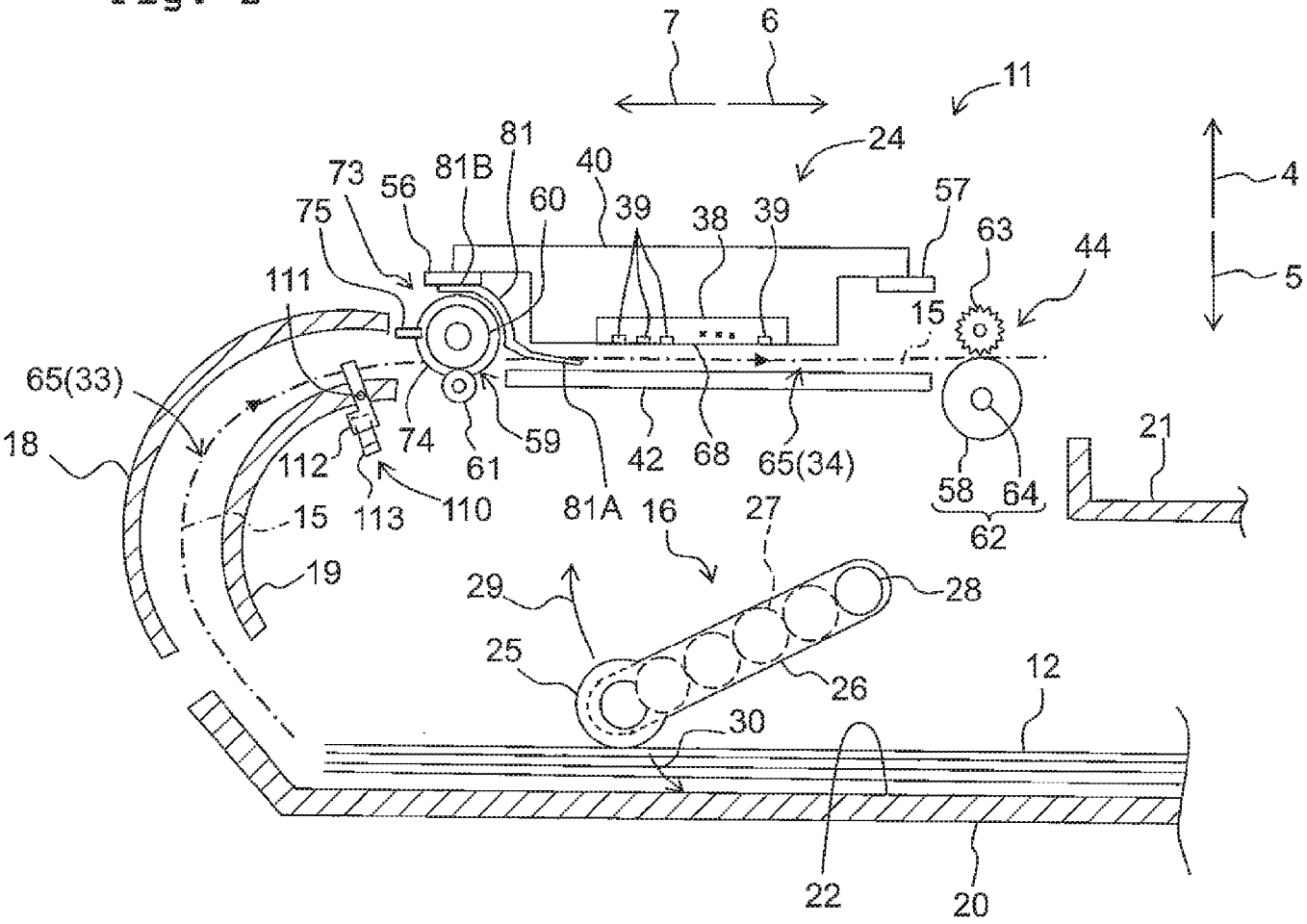
FIG. 2 is a vertical cross-sectional view schematically depicting an internal structure of a printer unit 11.

As depicted in FIG. 1, the opening 13 is formed in the front surface of the printer unit 11. Moving the feed tray 20 in the front direction 6 and the rear direction 7 enables the insertion and removal of the feed tray 20 with respect to the printer unit 11 via the opening 13. The feed tray 20 is a box-shaped member which is open at the upper side thereof. As depicted in FIG. 2, a plurality of sheets 12 are placed in a stacked state on a bottom plate 22 of the feed tray 20. A discharge tray 21 is supported on the front upper side of the feed tray 20. The discharge tray 21 is movable in the front direction 6 and rear direction 7. The sheet 12, for which an image is recorded by a recording unit 24, is discharged on and supported by the upper surface of the discharge tray 21.

<Feed Unit 16>

As depicted in FIG. 2, a feed unit 16 is disposed below the recording unit 24. The feed unit 16 includes a feed roller 25, a feed arm 26, a drive transmitting mechanism 27, and a shaft 28. The feed roller 25 is rotatably supported by the front end of the feed arm 26. The feed arm 26 pivots in directions indicated by arrows 29, 30 with the shaft 28 disposed at the base end of the feed arm 26 as the pivoting center. Accordingly, the feed roller 25 is capable of contacting with and separating away from the feed tray 20 or the sheet 12 supported by the feed tray 20.

The feed roller 25 rotates by receiving the driving force of a feed motor 102 (see FIG. 5) transmitted by the drive transmitting mechanism 27 formed of gears meshing with each other. Then, an uppermost sheet 12, of the sheets 12 supported by the bottom plate 22 of the feed tray 20, which is in contact with the feed roller 25 is fed to a conveyance route 65. The drive transmitting mechanism 27 is not limited to the form or structure formed of the gears meshing with each other. The drive transmitting mechanism 27 may be, for example, a belt stretched between the shaft 28 and the shaft of the feed roller 25.

<Conveyance Route 65>

As depicted in FIG. 2, the conveyance route 65 extends from the rear end of the feed tray 20. The conveyance route 65 includes a curved portion 33 and a linear portion 34. The curved portion 33 extends from the lower side to the upper side on the rear side of the printer unit 11 while being curved to make a U-turn. The linear portion 34 extends substantially in the front direction 6 and rear direction 7.

The curved portion 33 is defined by an outer guide member 18 and an inner guide member 19 facing each other with a predetermined gap intervened therebetween. The guide members 18, 19 extend in the right direction 8 and left direction 9 orthogonal to the sheet surface of FIG. 2. Each of the right direction 8 and left direction 9 is an exemplary width direction. The linear portion 34 is defined by the recording unit 24 and the platen 42 facing each other with a predetermined gap intervened therebetween in a position where the recording unit 24 is arranged.

The sheet 12 supported by the feed tray 20 is conveyed through the curved portion 33 by the feed roller 25, and then reaches the conveyance roller pair 59. The sheet 12 nipped or pinched by the conveyance roller pair 59 is conveyed toward a position facing the recording unit 24 in the front direction 6 through the linear portion 34. When the sheet 12 has reached the position immediately below the recording unit 24, an image is recorded thereon by the recording unit 24. The sheet 12, for which the image has been recorded, is conveyed through the linear portion 34 in the front direction 6 and is discharged on the discharge tray 21. As described above, the sheet 12 is conveyed in a conveyance direction 15 indicated by a dashed-dotted arrow in FIG. 2.

<Recording Unit 24>

As depicted in FIG. 2, the recording unit 24 is disposed above the linear portion 34. The recording unit 24 includes a carriage 40 and a recording head 38.

The carriage 40 is supported to be reciprocable in the right direction 8 and left direction 9 by two guide rails 56, 57 which are provided with a distance intervened therebetween in the front direction 6 and rear direction 7. The guide rail 56 is disposed on the upstream side of the recording head 38 in the conveyance direction 15. The guide rail 57 is disposed on the downstream side of the recording head 38 in the conveyance direction 15. The guide rails 56, 57 are supported by side frames (not depicted in the drawings) disposed outside the linear portion 34 of the conveyance route 65 in the right direction 8 and left direction 9. The carriage 40 moves by receiving the driving force from a carriage driving motor 103 (see FIG. 5).

The recording head 38 is carried on the carriage 40. The recording head 38 includes sub tanks (not depicted in the drawings) to which inks are supplied from ink cartridges (not depicted in the drawings); nozzles 39 disposed on a lower surface 68; ink channels (not depicted in the drawings) connecting the sub tanks and the nozzles 39; and piezoelectric elements 45 (see FIG. 5) each of which deforms a part of the ink channel to jet ink droplets from the nozzle 39. As will be described later, the piezoelectric elements 45 act upon receipt of power fed from the controller 130 (see FIG. 5).

Figure 4:
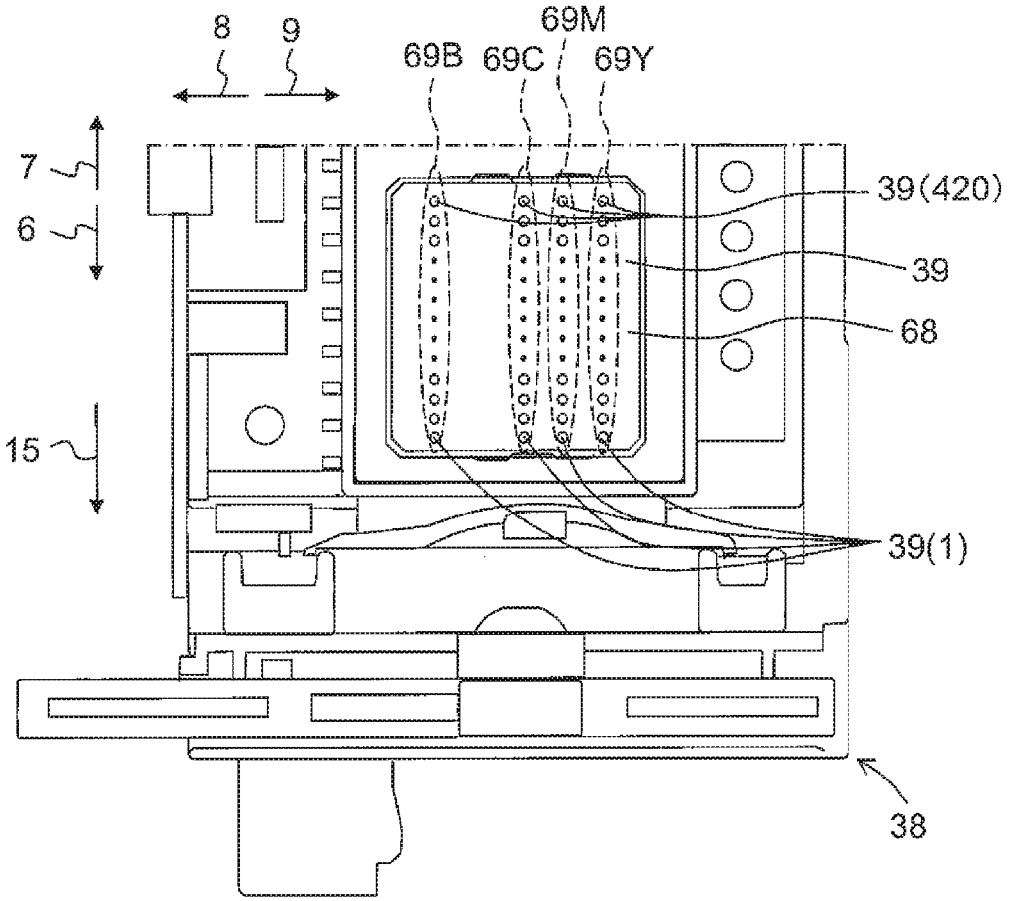
FIG. 4 is a bottom view of a recording head 38.

The sub tanks contain cyan ink, magenta ink, yellow ink, and black ink respectively. As depicted in FIG. 4, nozzle rows 69C, 69M, 69Y, 69B are formed in the lower surface 68. The nozzle row 69C is connected to the sub tank containing the cyan ink, the nozzle row 69M is connected to the sub tank containing the magenta ink, the nozzle row 69Y is connected to the sub tank containing the yellow ink, and the nozzle row 69B is connected to the sub tank containing the black ink. Each of the nozzle rows 69C, 69M, 69Y, 69B is formed of nozzles 39 aligned in the conveyance direction 15. In this embodiment, each of the nozzle rows 69C, 69M, 69Y, 69B is formed of 420 nozzles 39. The number of nozzles 39, however, is not limited to 420, and the number of nozzles 39 may be increased or decreased appropriately. The nozzle rows 69C, 69M, 69Y, 69B are arranged at intervals in the right direction 8 and left direction 9.

In the following, the nozzles 39 in each of the nozzle rows 69C, 69M, 69Y, 69B are designated by the nozzle 39(1) to the nozzle 39(420). Here, the nozzle 39(*n*) is the n-th nozzle 39 from the lowermost nozzle in the conveyance direction 15, of the nozzles 39 aligned in the conveyance direction 15. For example, the nozzle 39(1) is the 1st nozzle from the lowermost nozzle in the conveyance direction 15, of the nozzles 39 aligned in the conveyance direction 15, that is, the nozzle 39(1) is the lowermost nozzle in the conveyance direction 15; the nozzle 39(420) is the 420th nozzle from the lowermost nozzle in the conveyance direction 15, of the nozzles 39 aligned in the conveyance direction 15, that is, the nozzle 39(420) is the uppermost nozzle in the conveyance direction 15; and the nozzle 39(3) is the 3rd nozzle from the lowermost nozzle in the conveyance direction 15, of the nozzles 39 aligned in the conveyance direction 15.

As depicted in FIG. 2, the platen 42 (an exemplary support part) is provided below the linear portion 34 to face the recording head 38. The platen 42 supports the sheet 12 conveyed through the linear portion 34 of the conveyance route 65 in the conveyance direction 15.

Figure 3:
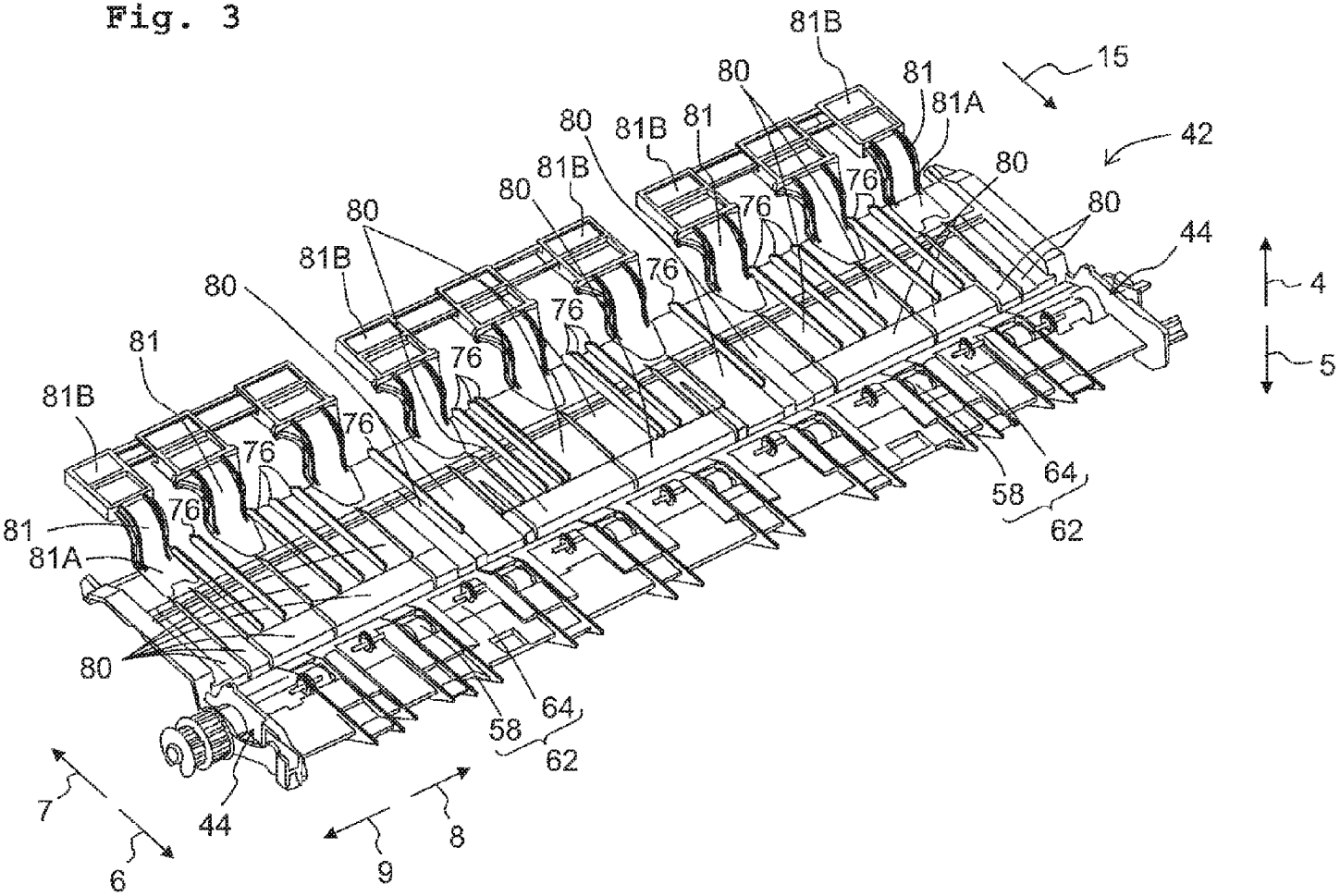
FIG. 3 is a perspective view depicting a platen 42, contact members 81, and a discharge roller pair 44.

As depicted in FIG. 3, the platen 42 is a plate-shaped member in which the length in the right direction 8 and the left direction 9 and the length in the front direction 6 and the rear direction 7 are longer than the length in the upper direction 4 and the lower direction 5. The length, of the platen 42, in the right direction 8 and the left direction 9 is longer than the length, of the platen 42, in the front direction 6 and the rear direction 7.

Ribs 76 are formed in an upper surface 80 of the platen 42. The sheet 12 is supported by upper end surfaces of the ribs 76. Each of the ribs 76 extends in the conveyance direction 15. The ribs 76 are formed at intervals in the right direction 8 and left direction 9.

Figure 5:
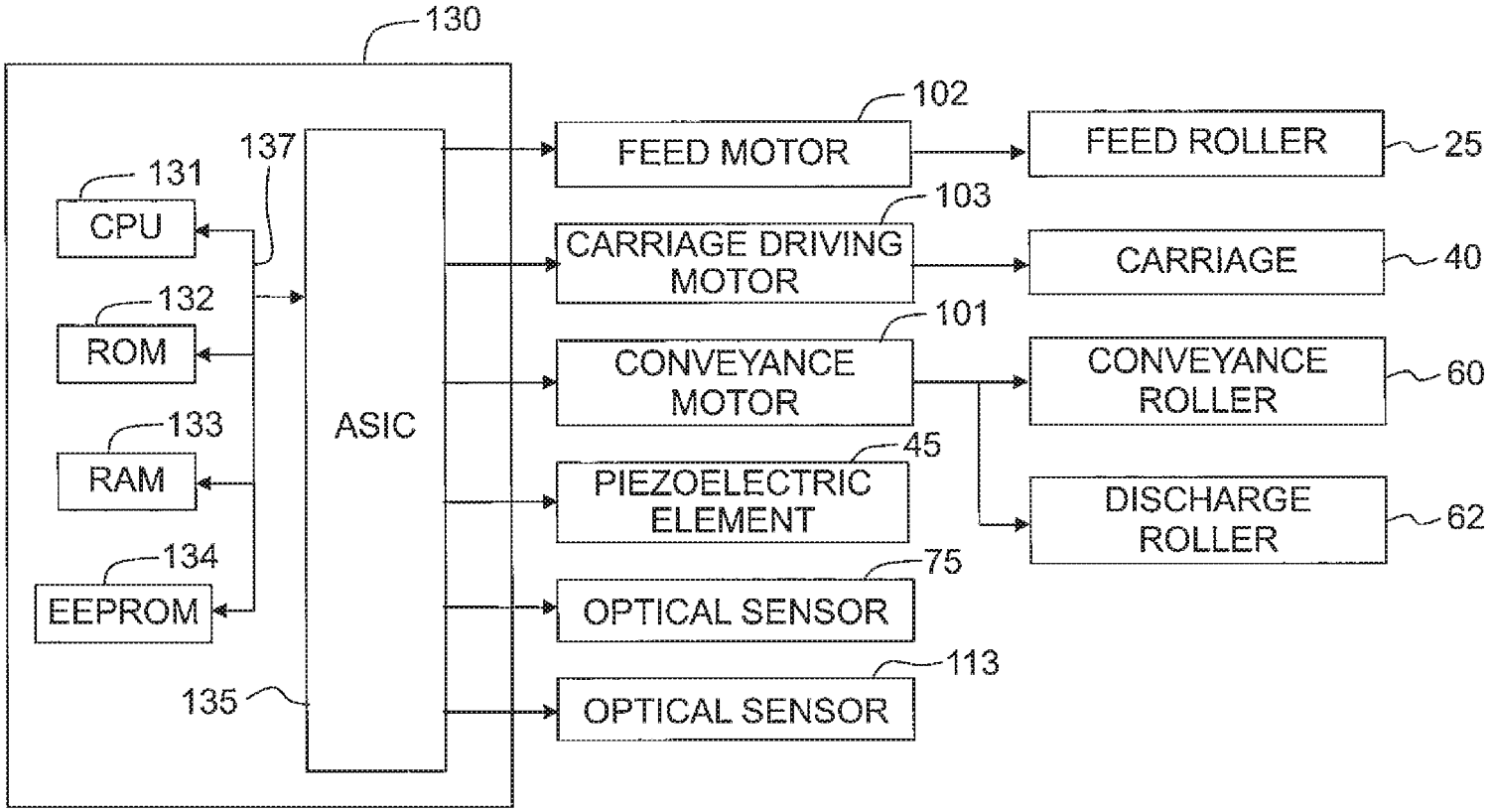
FIG. 5 is a block diagram of a configuration of a controller or control unit 130.

The recording unit 24 is controlled by the controller 130 (see FIG. 5). The recording head 38 jets ink droplets from nozzles 39 toward the upper surface 80 of the platen 42 during movement of the carriage 40 in the right direction 8 and left direction 9. Accordingly, an image is recorded on the sheet 12 supported by the platen 42 and conveyed through the linear portion 34 in the conveyance direction 15.

<Conveyance Roller Pair 59 and Discharge Roller Pair 44>

As depicted in FIG. 2, the conveyance roller pair 59 (an exemplary conveyance unit and exemplary upstream roller pair) is disposed in the linear portion 34 at the upstream side of the recording head 38 and the platen 42 in the conveyance direction 15. A discharge roller pair 44 (an exemplary conveyance unit and exemplary downstream roller pair) is disposed in the linear portion 34 at the downstream side of the recording head 38 and the platen 42 in the conveyance direction 15.

The conveyance roller pair 59 includes a conveyance roller 60 and a pinch roller 61 which is disposed on the lower side of the conveyance roller 60 to face the conveyance roller 60. The conveyance roller 60 is a hollow member in a cylindrical shape which extends in the right direction 8 and left direction 9. The conveyance roller 60 is rotatably supported by side frames. Pinch rollers 61 are provided at intervals in the right direction 8 and left direction 9. Each of the pinch rollers 61 is pressed against the conveyance roller 60 by use of an elastic member (not depicted in the drawings) such as a coil spring. The conveyance roller pair 59 can nip or pinch the sheet 12.

The discharge roller pair 44 includes a discharge roller 62 and a spur roller 63 which is disposed on the upper side of the discharge roller 62 to face the discharge roller 62. As depicted in FIG. 3, the discharge roller 62 has a shaft 64 which extends in the right direction 8 and left direction 9 and roller parts 58 which are attached to the shaft 64 to surround it at intervals in the right direction 8 and direction 9. The discharge roller 62 is rotatably supported by side frames. Spur rollers 63 are provided at intervals in the right direction 8 and left direction 9. Each of the spur rollers 63 is pressed against the discharge roller 62 by an elastic member (not depicted in the drawings) such as a coil spring. The illustration of spur rollers 63 is omitted in FIGS. 3 and 10. The discharge roller pair 44 can nip or pinch the sheet 12.

The conveyance roller 60 and the discharge roller 62 rotate by receiving the driving force from a conveyance motor 101 (see FIG. 5). When the conveyance roller 60 rotates in a state that the sheet 12 is pinched or nipped by the conveyance roller pair 59, the sheet 12 is conveyed by the conveyance roller pair 59 in the conveyance direction 15 and discharged onto the platen 42. When the discharge roller 62 rotates in a state that the sheet 12 is pinched or nipped by the discharge roller pair 44, the sheet 12 is conveyed by the discharge roller pair 44 in the conveyance direction 15 and discharged onto the discharge tray 21.

<Contact Member 81>

As depicted in FIG. 2, contact members 81 are disposed on the upstream side of nozzles 39 formed in the recording head 38 and the downstream side of the conveyance roller pair 59 in the conveyance direction 15. The contact members 81 are made of synthetic resin (e.g., polyacetal (POM)). The contact members 81 may be configured such that a plurality of members are combined or connected with each other by means of engagement or the like.

As depicted in FIG. 3, the contact members 81 are provided at intervals in the right direction 8 and left direction 9. Although nine contact members 81 are provided in this embodiment, the number of contact members 81 is not limited to nine and any number of contact members 81 may be provided. Further, although three contact members 81 are connected or coupled with each other in this embodiment, all of the contact members 81 may be provided independently or separately. Or, some of the contact members 81 may be connected or coupled with each other.

Upstream ends 81B of the contact members 81 in the conveyance direction 15 are attached to the guide rail 56 by any known means such as engagement.

Each of the contact members 81 has a curved portion extending downward and frontward from the upstream end 81B. This configuration allows the contact member 81 to extend to the vicinity of the upstream side in the conveyance direction 15 of the nozzle 39 disposed on the most upstream side. Further, each of the contact members 81 extends toward the platen 42 in the upper direction 4 and lower direction 5. Downstream ends 81A (exemplary contact parts, see FIG. 2) of the contact members 81 in the conveyance direction 15 can make contact with the upper surface of the sheet 12 supported by the platen 42.

The downstream end 81A of each of the contact members 81 is disposed between adjacent ribs 76 in the right direction 8 and left direction 9. Each of the ribs 76 is disposed between downstream ends 81A of adjacent contact members 81 in the right direction 8 and left direction 9. Namely, the downstream ends 81A of the contact members 81 and the ribs 76 are arranged alternately in the right direction 8 and left direction 9. The parts, of the downstream ends 81A of the contact members 81, making contact with the upper surface of the sheet 12 are positioned on the lower side of the upper end surfaces of the ribs 76.

Figure 6:
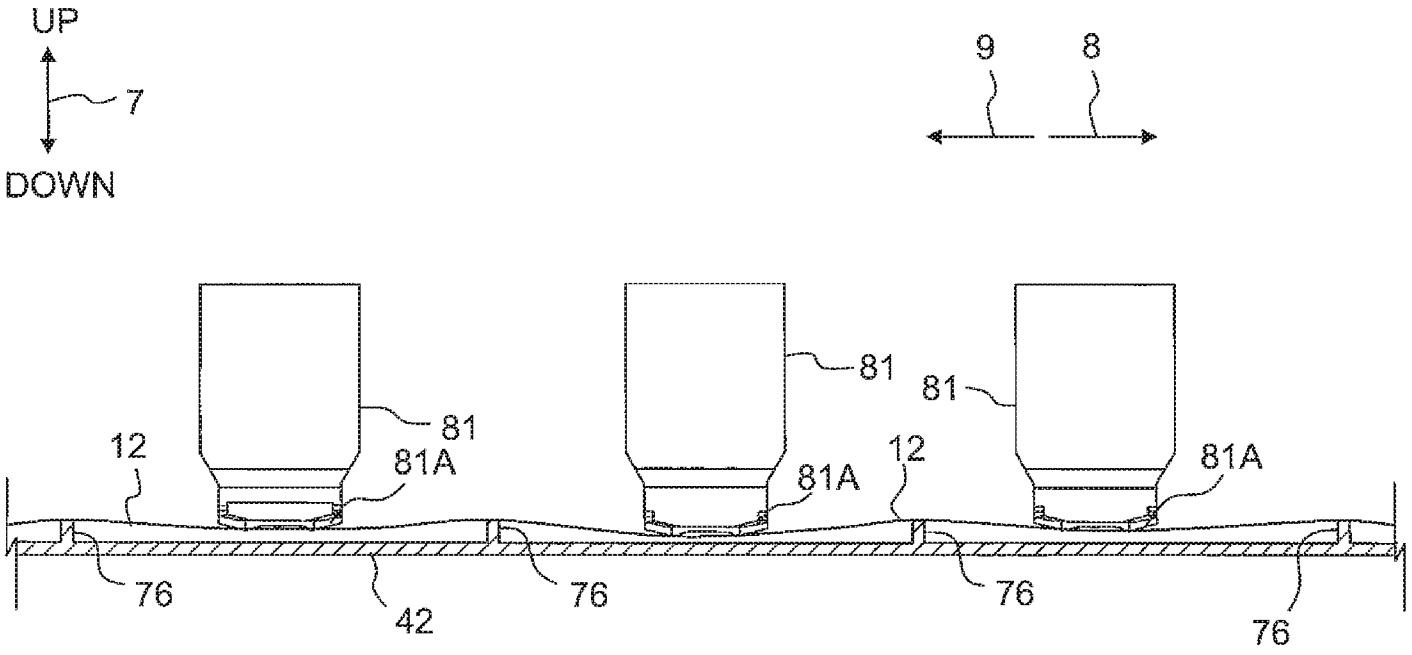
FIG. 6 is a cross-sectional view schematically depicting the platen 42, the contact members 81, and a sheet 12.

In the configuration in which the contact members 81 and the ribs 76 are arranged as described above, the sheet 12, which is supported by the upper end surfaces of the ribs 76 and is in contact with the downstream ends 81A of the contact members 81, is made to have a waved shape continued in the right direction 8 and left direction 9, as depicted in FIG. 6. Namely, the downstream ends 81A of the contact members 81 making contact with the upper surface of the sheet 12 cooperate with the ribs 76 to wave the sheet 12 along the right direction 8 and left direction 9.

<Detecting Unit 110>

As depicted in FIG. 2, a detecting unit 110 is provided on the upstream side of the conveyance roller pair 59 in the conveyance route 65 in the conveyance direction 15. The detecting unit 110 includes a shaft 111, a detecting element 112 which is pivotable around the shaft 111, and an optical sensor 113 having a light emitting element and a light receiving element which receives the light emitted from the light emitting element.

An end of the detecting element 112 projects into the conveyance route 65. When no external force is applied on the end of the detecting element 112, the other end of the detecting element 112 enters a light path of the optical sensor 113 ranging from the light emitting element to the light receiving element to block the light passing the light path. In this situation, the optical sensor 113 outputs a low-level signal to the controller 130 (see FIG. 5).

When the end of the detecting element 112 pivots by being pushed by the front end of the sheet 12, the other end of the detecting element 112 deviates from the light path. This allows the light to pass the light path. In this situation, the optical sensor 113 outputs a high-level signal to the controller 130. The controller 130 detects the downstream end (the front end) and the upstream end (the rear end) of the sheet 12 in the conveyance direction 15 based on the signal from the optical sensor 113.

<Rotary Encoder 73>

As depicted in FIG. 2, the conveyance roller 60 is provided with a rotary encoder 73 detecting a rotating amount of the conveyance roller 60. The rotary encoder 73 includes an encoder disk 74, which is provided in a shaft of the conveyance roller 60 to rotate together with the conveyance roller 60, and an optical sensor 75. A pattern, in which transmissive parts transmitting light and non-transmissive parts transmitting no light are disposed alternately at regular pitches in a circumferential direction, is formed in the encoder disk 74. Rotation of the encoder disk 74 generates a pulse signal every time the optical sensor 75 detects the transmissive part and the non-transmissive part. The generated pulse signal is outputted to the controller 130 (see FIG. 5). The controller 130 calculates the rotating amount of the conveyance roller 60 based on the pulse signal.

<Controller 130>

An explanation will be made about a schematic configuration of the controller 130 with reference to FIG. 5. Recording control by the controller 130 in accordance with a flowchart which will be described later achieves the present teaching. The controller 130 controls the overall operation of the multifunction peripheral 10. The controller 130 includes a CPU 131, a ROM 132, a RAM 133, an EEPROM 134, an ASIC 135, and an internal bus 137 connecting the above components with each other.

The ROM 132 stores, for example, programs for the CPU 131 by which various operations including the recording operation are controlled. The RAM 133 is used as a storage area temporarily recording data, signals, and the like which are used by the CPU 131 executing the above programs. Further, ink amount information as described later is stored, as database, in the RAM 133. The EEPROM 134 stores settings, flags, and the like which should be retained even after the power is turned off.

The ASIC 135 is connected to the conveyance motor 101, the feed motor 102, and the carriage driving motor 103. Driving circuits controlling respective motors are incorporated in the ASIC 135. When the CPU 131 inputs the driving signal for rotating each of the motors to the driving circuit corresponding to each of the motors, the driving current corresponding to the driving signal is outputted to each of the motors through the corresponding driving circuit. This configuration rotates each of the motors. Namely, the controller 130 controls the motors 101, 102, and 103.

The pulse signal outputted from the optical sensor 75 is inputted into the ASIC 135. The controller 130 calculates the rotating amount of the conveyance roller 60 based on the pulse signal from the optical sensor 75. The controller 130 calculates the conveyance amount of the sheet 12 from the rotating amount of the conveyance roller 60. The ASIC 135 is connected to the optical sensor 113. The controller 130 detects, based on the signal from the optical sensor 113, the front end and rear end of the sheet 12 in the position where the detecting unit 110 is disposed. The controller 130 recognizes the position of the sheet 12 conveyed through the conveyance route 65 based on the timing at which the detecting element 110 detects the front end or rear end of the sheet 12 and the conveyance amount of the sheet 12. Namely, each of the detecting element 110 and the rotary encoder 73 is an exemplary detecting unit.

The ASIC 135 is connected to the piezoelectric elements 45. The piezoelectric elements 45 act by being subjected to power feeding by the controller 130 via unillustrated driving circuits. The controller 130 controls the power feeding to piezoelectric elements 45 to selectively jet ink droplets from nozzles 39 constituting nozzle rows 69C, 69M, 69Y, 69B. Namely, the controller 130 jets ink droplets from a part or all of the nozzles 39.

Figure 7:
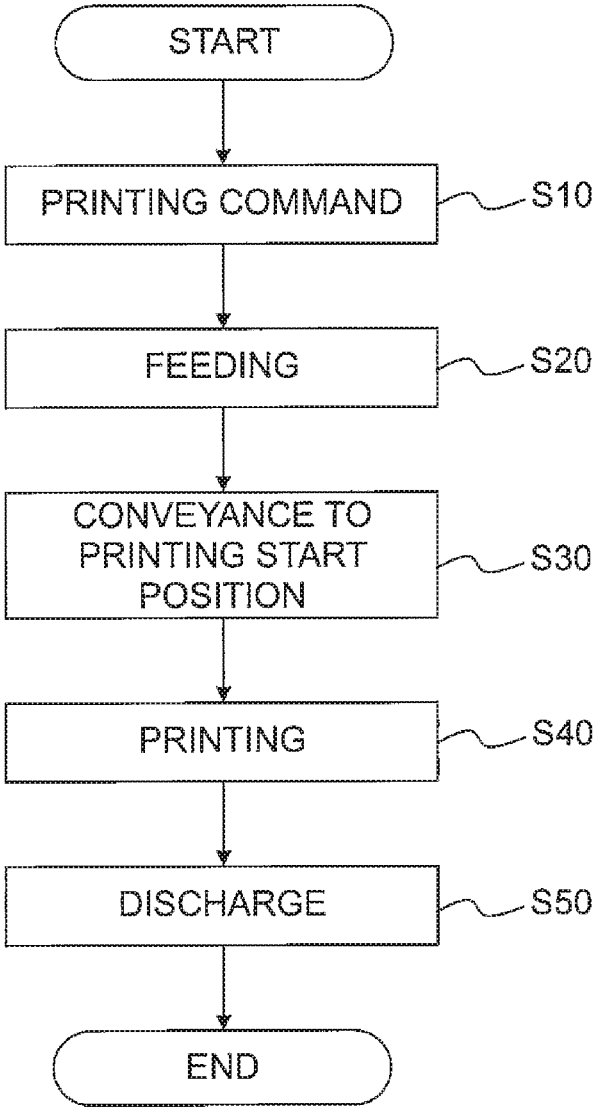
FIG. 7 is a flowchart illustrating a recording control process.

In a printing step (S40 in FIG. 7) of the recording control process which will be described later, the controller 130 calculates the ink amount, which is jetted by the recording head 38 during each recording process of the recording control process, based on printing data. The printing data is data corresponding to an image formed on the sheet 12 by printing. The process in which the controller 130 calculates the ink amount is an exemplary calculation process of the present teaching. The controller 130 stores information of the calculated ink amount in the RAM 133.

The calculation of the ink amount is performed, for example, as follows. Namely, the controller 130 determines the kind(s) of ink droplets (for example, only one ink (black ink) for black-and-white printing and at least one of cyan, magenta, yellow, and black inks for color printing, that is, one to four kinds of inks may be used for color printing) jetted on the sheet 12 by the recording head 38 during image recording and the number of jettings of ink droplets of each of cyan, magenta, yellow, and black inks (ink with higher concentration has a larger number of jettings of ink droplets), with reference to printing data. The controller 130 calculates values, each of which is obtained by multiplying ink droplets of each of the four inks by the number of jettings of ink droplets thereof, and then sums up the calculated four values. The ink amount jetted on the sheet 12 is calculated, accordingly. Although the explanation is made by citing, as color inks, three colors of inks including cyan, magenta, and yellow in this embodiment, the present teaching is not limited thereto. The present teaching can use inks in other colors (e.g., white ink, light cyan ink, light magenta ink, and light yellow ink) as needed.

The controller 130 performs the setting in which the upper surface 80 of the platen 42 is divided into a plurality of areas. The areas are divided along the right direction 8 and left direction 9.

Figure 10A:
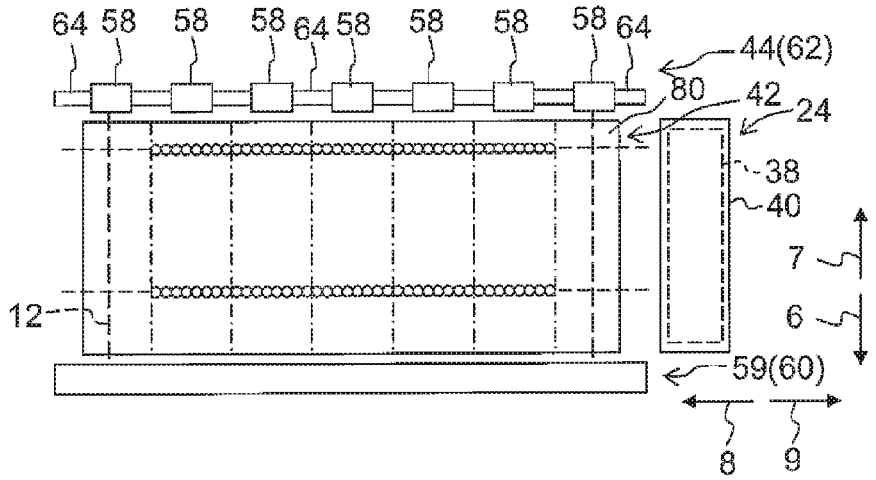
Figure 10B:
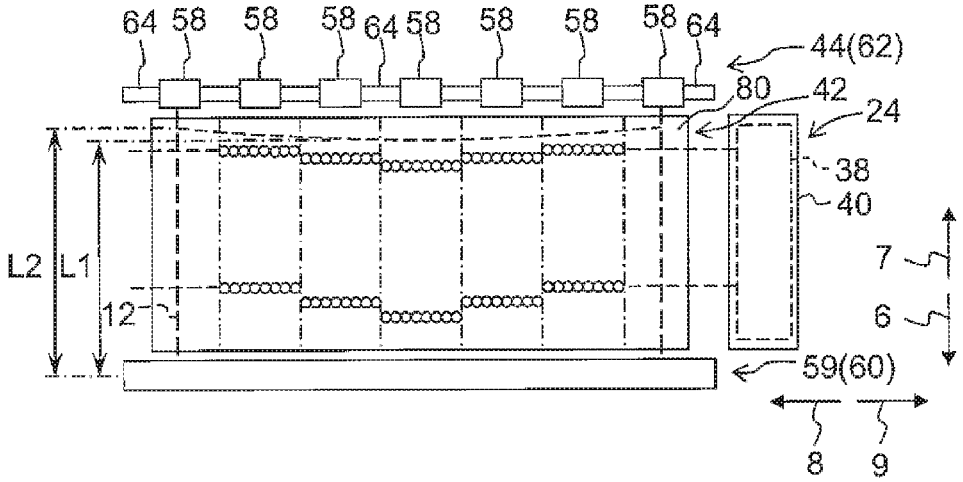
Figure 10C:
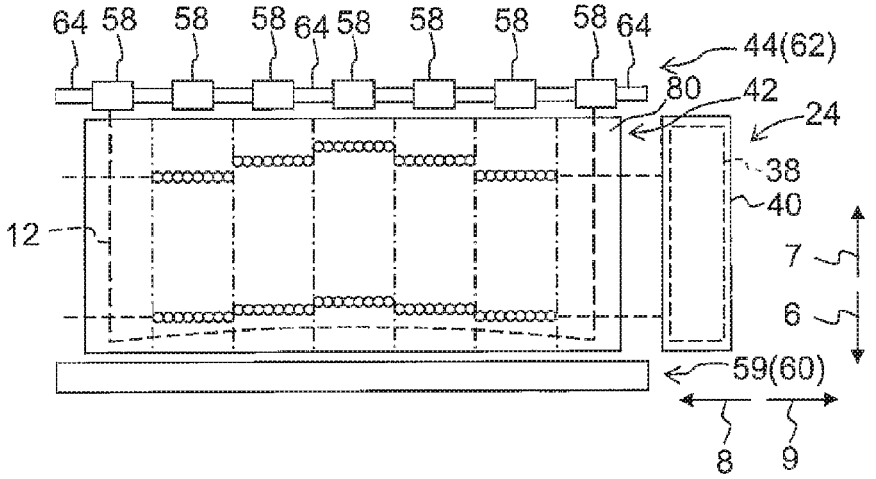

For example, as depicted in FIGS. 10B and 10C, the upper surface 80 is divided into five areas. The five areas include a center area CA and four outer areas OA (two outer areas OA1 and two outer areas OA2). The center area CA is disposed at the center of the upper surface 80 in the right direction 8 and left direction 9. The outer areas OA1 are adjacent to the center area CA in the right direction 8 and left direction 9. The outer areas OA2 are adjacent to the outer areas OA1 in the right direction 8 and left direction 9. Note that the outer areas OA are not limited to the outer areas OA1 and OA2. For example, the upper surface 80 may be divided into three areas including the center area CA and two outer areas OA1. Or, the upper surface 80 may be divided into seven areas including the center area CA, two outer areas OA1, two outer areas OA2, and two outer areas OA3. The outer areas OA3 are disposed adjacent to the outer areas OA2 in the right direction 8 and left direction 9.

When the recording head 38 jets ink droplets, the controller 130 shifts nozzles 39, from which ink droplets are jetted to the center area CA, to the downstream side in the conveyance direction 15 by a predetermined number, relative to nozzles 39 from which ink droplets are jetted to outer areas OA.

For example, when the recording head 38 jets ink droplets to the center area CA, the controller 130 controls the recording head 38 to jet ink droplets from nozzles 39(3) to 39(402). When the recording head 38 jets ink droplets to the outer areas OA1, the controller 130 controls the recording head 38 to jet ink droplets from nozzles 39(2) to 39(401). When the recording head 38 jets ink droplets to the outer areas OA2, the controller 130 controls the recording head 38 to jet ink droplets from nozzles 39(1) to 39(400). That is, in this embodiment, the controller 130 shifts nozzles 39 to be used to the downstream side in the conveyance direction 15 one by one, as an area to which ink droplets are jetted by the recording head 38 is closer to the right end or left end of the upper surface 80. Namely, the controller 130 shifts nozzles 39 to be used to the downstream side in the conveyance direction 15 by a larger number, as an area to which ink droplets are jetted by the recording head 38 is closer to the right end or left end of the upper surface 80.

In the above example, the controller 130 shifts nozzles 39 to be used to the downstream side in the conveyance direction 15, as an area to which ink droplets are jetted by the recording head 38 is closer to the right end or left end of the upper surface 80. The controller 130, however, may shift nozzles 39 to be used to the upstream side in the conveyance direction 15.

The number of shifts of nozzles 39 is not limited to one. For example, the controller 130 may shift nozzles 39 to be used to the downstream side in the conveyance direction 15 two by two, as an area to which ink droplets are jetted by the recording head 38 is closer to the right end or left end of the upper surface 80.

In the above example, the controller 130 shifts nozzles 39 one by one at boundaries between adjacent different areas, that is, all of the areas CA, OA1, and OA2 have the same number of shifts of nozzles 39. The areas CA, OA1, and OA2, however, may have the number of shifts of nozzles 39 different from each other. For example, when the recording head 38 jets ink droplets to the center area CA, the controller 130 controls the recording head 38 to jet ink droplets from nozzles 39(6) to 39(405). When the recording head 38 jets ink droplets to the outer areas OA1, the controller 130 controls the recording head 38 to jet ink droplets from nozzles 39(3) to 39(402). When the recording head 38 jets ink droplets to the outer areas OA2, the controller 130 controls the recording head 38 to jet ink droplets from nozzles 39(1) to 39(400). Namely, the number of shifts of nozzles 39 is three at boundaries between the center area CA and the outer areas OA1, and the number of shifts of nozzles 39 is two at boundaries between the outer areas OA1 and the outer areas OA2.

As described above, the controller 130 controls the recording unit 24 to jet ink droplets, to various numbers of areas set by the controller 130, from nozzles 39 shifted by various numbers.

The number of areas in the upper surface 80 of the platen 42 to be divided by the controller 130 and the number of shifts of nozzles 39 in each of the areas for recording control which will be described later are determined based on test printing as follows.

For example, in a state that the front end of the sheet 12 does not reach the discharge roller pair 44, that is, in a state that the conveyance roller pair 59 nips the sheet 12 but the discharge roller pair 44 does not nip the sheet 12, the controller 130 jets ink droplets to the sheet 12 only from the nozzle 39(1) while moving the carriage 40 just once from the right end to the left end or from the left end to the right end of the conveyance route 65. This forms a straight or curved line on the sheet 12 along the right direction 8 and left direction 9. A user determines the number of areas to be divided by the controller 130 and the number of shifts of nozzles 39 based on degree of curve of the printed line. Specifically, when degree of curve of the printed line is great, a large number of areas to be divided by the controller 130 and a large number of shifts of nozzles 39 are set by the user. When degree of curve of the printed line is small, a small number of areas to be divided by the controller 130 and a small number of shifts of nozzles 39 are set by the user.

For example, the test printing may be performed a plurality of times under the same conditions except that the number of areas to be divided by the controller 130 and the number of shifts of nozzles 39 are changed gradually. The user may determine the number of areas to be divided by the controller 130 and the number of shifts of nozzles 39 such that they are identical to those obtained in the test printing in which degree of curve of the printed line is the smallest.

The number of areas to be divided by the controller 130 and the number of shifts of nozzles 39 may be set, for example, by a manufacturer before shipment of the multifunction peripheral 10, or may be set, for example, by a user after shipment of the multifunctional peripheral 10. The number of areas to be divided by the controller 130 and the number of shifts of nozzles 39 which have been set by the manufacturer, the user, or the like are stored in the ROM 132, RAM 133, or EEPROM 134 of the controller 130.

The number of areas to be divided by the controller 130 and the number of shifts of nozzles 39 are input through an operation unit 17 (see FIG. 1) of the multifunction peripheral 10. Instead of inputting the number of areas to be divided by the controller 130 and the number of shifts of nozzles 39, an optimal pattern may be selected from among patterns having different numbers of areas to be divided by the controller 130 and different numbers of shifts of the nozzles 39. The number of areas to be divided by the controller 130 and the number of shifts of nozzles 39 determined are stored in the ROM 132, RAM 133, or EEPROM 134.

The state of the sheet 12 during the test printing is not limited to the state as described above (the state in which the conveyance roller pair 59 nips the sheet 12 but the discharge roller pair 44 does not nip the sheet 12). For example, the state of the sheet 12 may be a state in which the discharge roller pair 44 nips the sheet 12 but the conveyance roller pair 59 does not nip the sheet 12.

The number of areas to be divided by the controller 130 and the number of shifts of nozzles 39 may be determined by any other method than the above examples.

<Recording Control by Controller 130>

In the printer unit 11 having the above configuration, the controller 130 performs the recording control in which the sheet 12 is fed and conveyed and an image is recorded on the sheet 12 based on printing data. The recording control process will be explained below with reference to the flow charts of FIGS. 7 and 8.

When the printing command for the sheet 12 is sent to the controller 130 from the operation unit 17 (see FIG. 1) of the multifunction peripheral 10 or an external device connected to the malfunction peripheral 10 (S10), the controller 130 controls the feed roller 25 to convey the sheet 12 supported by the feed tray 20 to the conveyance route 65 (S20). The controller 130 controls the conveyance roller pair 59 to convey the sheet 12 in the conveyance direction 15 until the sheet 12 reaches a printing start position facing the recording unit 24 (S30). In this context, the printing start position is a position at which the downstream end of an image recording area of the sheet 12 in the conveyance direction 15 faces the nozzle 39(1) disposed on the lowermost side of the nozzles 39 in the conveyance direction 15.

Subsequently, the controller 130 performs the process of recording an image on the sheet 12 (S40, the process of FIGS. 8A and 8B). Details of the step S40 will be described later. When the process of recording an image on the sheet 12 is completed, the controller 130 controls the discharge roller pair 44 to convey the sheet 12 in the conveyance direction 15. Accordingly, the sheet 12 is discharged on the discharge tray 21 (S50).

In the following, details of the step S40 will be explained with reference to the flowchart of FIGS. 8A and 8B. At first, the flow of the process of recording an image on the sheet 12 will be explained.

When an image is recorded on the sheet 12, the controller 130 controls the conveyance motor 101 to perform an intermittent conveyance process in which the conveyance roller pair 59 and the discharge roller pair 44 repeat the conveyance of the sheet 12 by a predetermined linefeed and the stop of conveyance of the sheet 12 alternately (S300).

The controller 130 performs the recording process while the conveyance of the sheet 12 is being stopped in the intermittent conveyance process. In the recording process, the controller 130 controls the power feed to each piezoelectric element 45 to jet ink droplets from each nozzle 39 (S240, S260, S280, S330) while moving the carriage 40 in the right direction 8 and left direction 9 (S220, S230, S250, S270, S290, S320, S340). Namely, the controller 130 performs the recording process such that ink droplets are jetted from nozzles 39 during a single pass (hereinafter referred also to as one pass) in which the carriage 40 moves from end to end in a printing range.

In the recording process, the controller 130 determines, based on printing data, nozzles 39, of the nozzles 39, to be used for jetting of ink droplets. For example, the controller 130 determines, based on printing data, the color(s) of ink(s) to be used for recording and nozzles 39, of the nozzles 39, which correspond to the color(s) of ink(s) to be used for recording and from which ink droplets are jetted.

As the number of areas to be divided by the controller 130 and the number of shifts of nozzles 39 to be used in the recording process, the controller 130 uses them which have been stored in the ROM 132, RAM 133, or EEPROM 134 based on the test printing performed in advance. In this embodiment, the number of areas to be divided by the controller 130 is five areas (the center area CA, two outer areas OA1, and two outer areas OA2), and the number of shifts of nozzles 39 is one.

The controller 130 controls the recording head 38 to jet ink droplets from one or more of nozzles 39 of the nozzles 39, based on printing data, the number of areas to be divided by the controller 130, and the number of shifts of nozzles 39. Accordingly, an image, of printing data, corresponding to the current pass is recorded on the sheet 12.

The controller 130 alternately performs the intermittent conveyance process (S300) in which the sheet 12 is conveyed and the recording process (S230 to S280, S320 to S340) in which ink droplets are jetted from nozzles 39 based on the printing data corresponding to the single pass, until printing of all the printing data is performed on the sheet 12 (S310: Yes). Accordingly, an image based on the printing data is recorded on the sheet 12.

Subsequently, an explanation will be made about each of the processes in the flowchart of FIGS. 8A and 8B. The controller 130 determines whether or not the sheet 12 is in a position in which the sheet 12 is nipped by both of the conveyance roller pair 59 and the discharge roller pair 44, based on signals from the detecting unit 110 and the rotary encoder 73 (S210).

When the sheet 12 is in the printing start position, the front end of the sheet 12 does not reach the discharge roller pair 44. In this situation, the rear end of the sheet 12 is positioned on the upstream side of the conveyance roller pair 59 in the conveyance direction 15. Thus, when the sheet 12 is in the printing start position, the sheet 12 is nipped by the conveyance roller pair 59 but is not nipped by the discharge roller pair 44 (S210: No).

Next, the controller 130 controls the carriage 40 to start movement from one end or the other end in the printing range (S220). In this situation, as depicted in FIG. 10B, the carriage 40 moves to a position in which ink droplets are jetted to one of the outer areas OA2; a position in which ink droplets are jetted to one of the outer areas OA1; a position in which ink droplets are jetted to the center area CA; a position in which ink droplets are jetted to the other of the outer areas OA1; and a position in which ink droplets are jetted to the other of the outer areas OA2 in that order.

When the carriage 40 is in the position in which ink droplets are jetted to the center area CA (S230: Yes) during the movement of the carriage 40 from one end to the other end in the printing range, the controller 130 controls the recording head 38 to jet ink droplets from nozzles 39(10) to 39(410) (S240).

When the carriage 40 is in the position in which ink droplets are jetted to each of the outer areas OA1 (S250: Yes), the controller 130 controls the recording head 38 to jet ink droplets from nozzles 39(9) to 39(409) shifted to the downstream side in the conveyance direction 15 by one relative to nozzles used in the step S240 (S260).

When the carriage 40 is in the position in which ink droplets are jetted to each of the outer areas OA2 (S270: Yes), the controller 130 controls the recording head 38 to jet ink droplets from nozzles 39(8) to 39(408) shifted to the downstream side in the conveyance direction 15 by two relative to nozzles used in the step S240 (S280).

Performing the steps S240, S260, and S280 records images in areas CA, OA1, OA2, as depicted in FIG. 10B. FIGS. 10A to 10C each depict circles which schematically represent images formed by ink droplets jetted from the lowermost and uppermost nozzles 39 of the nozzles 39, namely, images formed by ink droplets jetted from nozzles 39 other than the lowermost and uppermost nozzles 39 are omitted in FIGS. 10A to 10C.

Jetting of ink droplets from nozzles 39 based on printing data is performed until the carriage 40 reaches the other end or one end of the printing range (S290: No). When the carriage 40 has reached the other end or one end of the printing range (S290: Yes), the controller 130 controls the conveyance motor 101 to convey the sheet 12 with the conveyance roller pair 59 and the discharge roller pair 44 by a predetermined linefeed (S300).

When there is no unprinted data (S310: Yes), printing is completed. When there is unprinted data (S310: No), the step S210 is performed again. When the state in which the sheet 12 is nipped by the conveyance roller pair 59 but is not nipped by the discharge roller pair 44 is maintained (S210: No), the steps S220 to S290 are performed again.

When the downstream end of the sheet 12 in the conveyance direction 15 has reached the discharge roller pair 44 as a result of conveyance of the sheet 12 in the step S300, the sheet 12 may be nipped by both of the conveyance roller pair 59 and the discharge roller pair 44 (S210: Yes). In this case, the controller 130 controls the carriage 40 to start movement from one end or the other end of the printing range (S320). The controller 130 controls the recording head 38 to jet ink droplets from nozzles 39 based on printing data while moving the carriage 40 (S330). No nozzles 39 are shifted under this situation. Namely, ink droplets are jetted from the same nozzles 39(10) to 39(410) during movement of the carriage 40.

Performing the step S330 records images in areas CA, OA1, OA2, as depicted in FIG. 10A.

Jetting of ink droplets from nozzles 39 based on printing data is performed until the carriage 40 reaches the other end or one end of the printing range (S340: No). When the carriage 40 has reached the other end or one end of the printing range, the controller 130 controls the conveyance motor 101 to convey the sheet 12 with the conveyance roller pair 59 and the discharge roller pair 44 by a predetermined linefeed (S300).

When there is no unprinted data (S310: Yes), printing is completed. When there is unprinted data (S310: No), the step S210 is performed again. When the state in which the sheet 12 is nipped by both of the conveyance roller pair 59 and the discharge roller pair 44 is maintained (S210: Yes), the steps S320 to S340 are performed again.

When the upstream end of the sheet 12 in the conveyance direction 15 has passed the conveyance roller pair 59 as a result of conveyance of the sheet 12 in step S300, that is, when the sheet 12 is nipped by the discharge roller pair 44 but is not nipped by the conveyance roller pair 59 (S210: No), the steps S220 to S290 are performed again. Note that in steps S260 and S280, nozzles 39 are shifted not to the downstream side but to the upstream side in the conveyance direction 15. Namely, in the step S260, the controller 130 controls the recording head 38 to jet ink droplets from nozzles 39(11) to 39(411) shifted to the upstream side in the conveyance direction 15 by one relative to nozzles used in the step S240. In the step S280, the controller 130 controls the recording head 38 to jet ink droplets from nozzles 39(12) to 39(412) shifted to the upstream side in the conveyance direction 15 by two relative to nozzles used in the step S240.

Performing the steps S240, S260, and S280 records images in areas CA, OA1, OA2, as depicted in FIG. 10C.

Jetting of ink droplets from nozzles 39 based on printing data is performed until the carriage 40 reaches the other end or one end of the printing range (S290: No). When the carriage 40 has reached the other end or one end of the printing range (S290: Yes), the controller 130 controls the conveyance motor 101 to convey the sheet 12 with the conveyance roller pair 59 and the discharge roller pair 44 by a predetermined linefeed (S300).

When there is no unprinted data (S310: Yes), printing is completed. When there is unprinted data (S310: No), the step S210 is performed again.

Effects of the Embodiment

In the embodiment, the controller 130 shifts nozzles 39 relative to the sheet 12, which is made to wave in the right direction 8 and left direction 9. This reduces twist or distortion of an image to be recorded on the sheet 12. Thus, it is possible to reduce deterioration in quality of an image to be recorded on the sheet 12.

In the embodiment, when the sheet 12 supported by the platen 42 is nipped by the conveyance roller pair 59 but is not nipped by the discharge roller pair 44, a part, of the sheet 12, supported by the platen 42 is made to come closer to the center in the right direction 8 and left direction 9. Thus, the distance, between the nip position of the sheet 12 by the conveyance roller pair 59 and the front end of the sheet 12 in the conveyance direction 15, at the center in the right direction 8 and left direction 9 is shorter than the distance therebetween at both ends in the right direction 8 and left direction 9. Specifically, as depicted in FIG. 10B, a distance L1 is shorter than a distance L2 When an image is recorded on the sheet 12 under this situation without shifts of nozzles 39, the image recorded on the sheet 12 twists or gets distorted so that the center in the right direction 8 and left direction 9 is positioned on the upstream side of both ends in the right direction 8 and left direction 9, in the conveyance direction 15. Thus, in the embodiment, when ink droplets are jetted from nozzles 39 to the center area CA in the recording process, the controller 130 shifts nozzles 39 to the upstream side in the conveyance direction 15 relative to nozzles 39 from which ink droplets are jetted to the outer areas OA1, OA2. This reduces twist or distortion of the image to be recorded on the sheet 12.

When the sheet 12 is nipped by both of the conveyance roller pair 59 and the discharge roller pair 44, the degree of movement of the sheet 12 toward the center in the right direction 8 and left direction 9 is nearly zero. Thus, like the embodiment, no nozzles 39 are shifted when the sheet 12 is nipped by both of the conveyance roller pair 59 and the discharge roller pair 44. This reduces deterioration in quality of an image which would be otherwise caused by shifts of nozzles 39 performed when the degree of movement of the sheet 12 toward the center in the right direction 8 and left direction 9 is nearly zero.

In the embodiment, the contact members 81 of the multifunction peripheral 10 easily wave the sheet 12, which is supported by the platen 42, in the right direction 8 and left direction 9. A part, of the sheet 12 having the waved shape, supported by the platen 42 is made to come closer to the center in the right direction 8 and left direction 9. However, the multifunction peripheral 10 having the configuration described in the embodiment can reduce twist or distortion of an image to be recorded on the sheet 12.

In the embodiment, the number of shifts of nozzles 39 can be changed finely by setting outer areas OA in the upper surface 80 of the platen 42. This reduces twist or distortion of an image to be recorded on the sheet 12.

First Modified Embodiment

In the embodiment, no nozzles 39 are shifted when the sheet 12 is nipped by both of the conveyance roller pair 59 and the discharge roller pair 44. Nozzles 39, however, may be shifted when the sheet 12 is nipped by both of the conveyance roller pair 59 and the discharge roller pair 44.

Figure 9A:
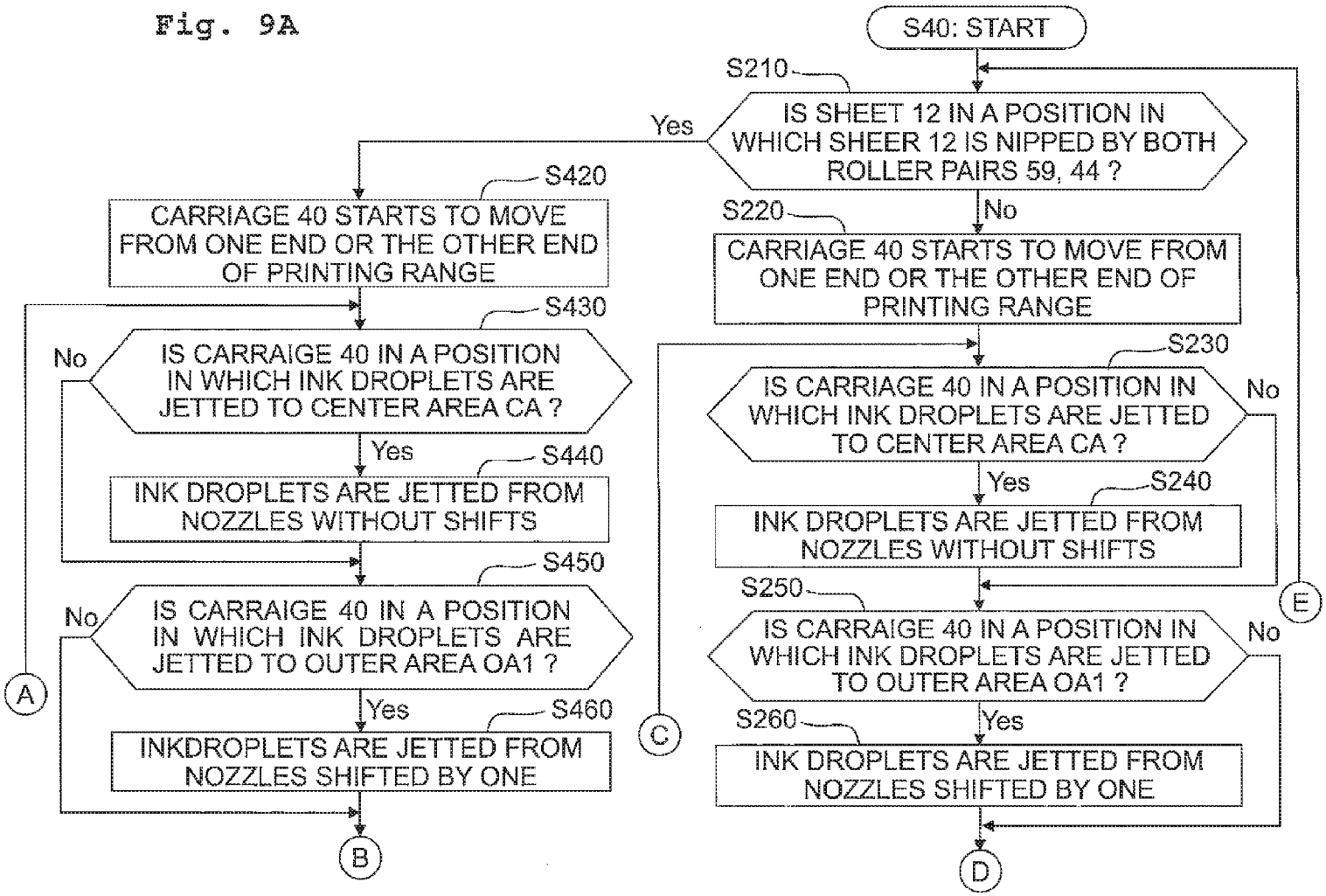
FIGS. 9A and 9B are flowcharts illustrating details of step S40 in FIG. 7 according to the first modified embodiment.
Figure 9B:
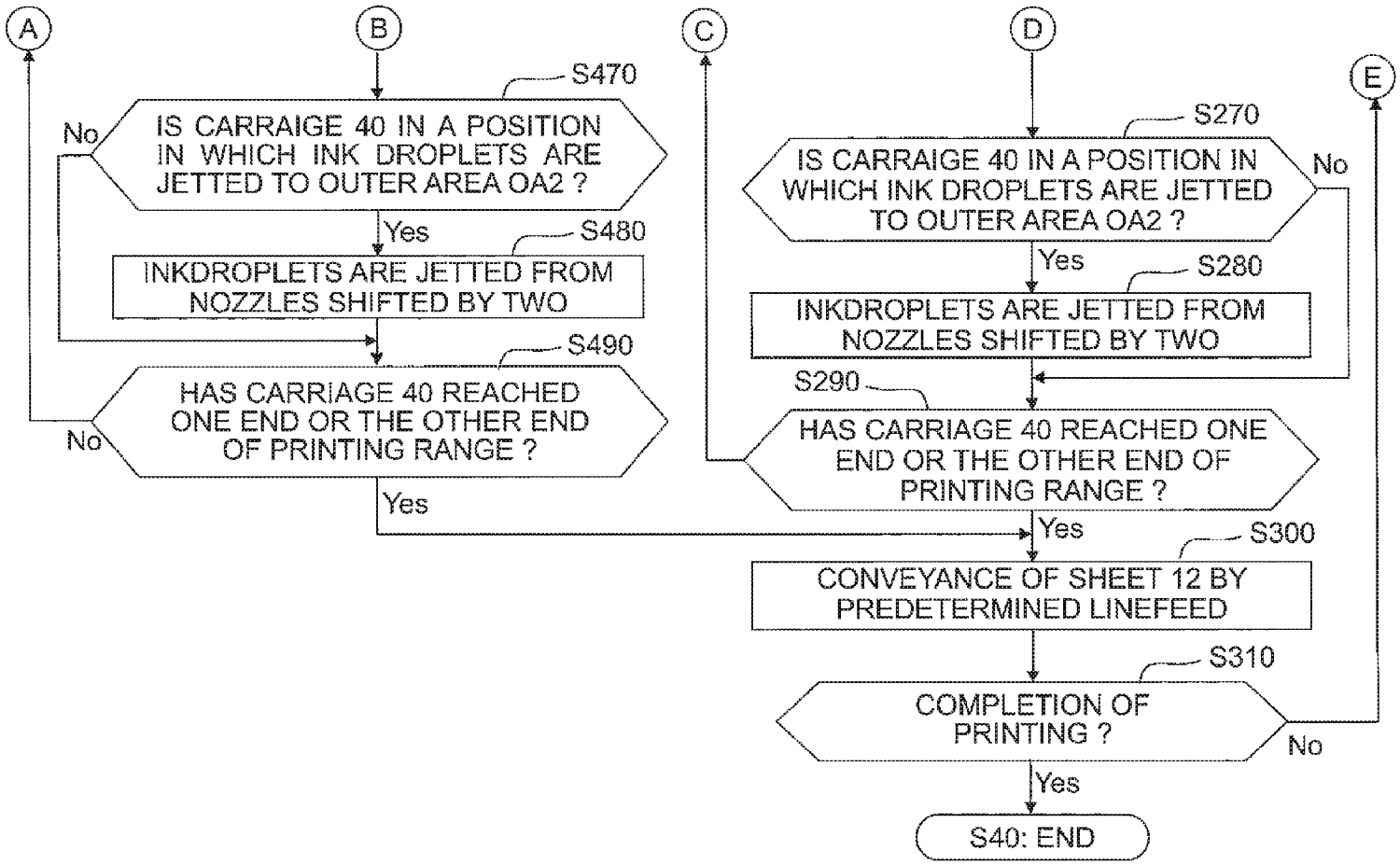

In such a case, as depicted in FIG. 9A, when the sheet 12 is nipped by both of the conveyance roller pair 59 and the discharge roller pair 44 (S210: Yes), the controller 130 performs a process similar to the process ranging from steps S220 to S290 (S420 to S490). Note that the number of shifts of nozzles 39 in the steps S460 and S480 is different from that in the steps S260 and S280. It is preferred that the number of shifts of nozzles 39 in the steps S460 and S480 be smaller than that in the steps S260 and S280.

For example, when the sheet 12 is nipped by any one of the conveyance roller pair 59 and the discharge roller pair 44 (S210: No), the controller 130 controls, in the step S260, the recording head 38 to jet ink droplets from nozzles 39 shifted to the upstream or downstream side in the conveyance direction 15 by two relative to nozzles 39 used in the step S240. Further, the controller 130 controls, in the step S280, the recording head 38 to jet ink droplets from nozzles 39 shifted to the upstream or downstream side in the conveyance direction 15 by four relative to nozzles 39 used in the step S240.

When the sheet 12 is nipped by both of the conveyance roller pair 59 and the discharge roller pair 44 (S210: Yes), the controller 130 controls, in the step S460, the recording head 38 to jet ink droplets from nozzles 39 shifted to the upstream or downstream side in the conveyance direction 15 by one relative to nozzles 39 used in the step S440. Further, the controller 130 controls, in the step S480, the recording head 38 to jet ink droplets from nozzles 39 shifted to the upstream or downstream side in the conveyance direction 15 by two relative to nozzles 39 used in the step S440.

The degree of movement of the sheet 12 toward the center in the right direction 8 and left direction 9 in a state that the sheet 12 is nipped by both of the conveyance roller pair 59 and the discharge roller pair 44 is different from that in a state that the sheet 12 is nipped by any one of the conveyance roller pair 59 and the discharge roller pair 44. Thus, in the first modified embodiment, the number of shifts of nozzles 39 depends on whether the sheet 12 is nipped by both of the conveyance roller pair 59 and the discharge roller pair 44 or any one of the conveyance roller pair 59 and the discharge roller pair 44. This configuration reduces twist or distortion of an image to be recorded on the sheet 12.

Second Modified Embodiment

In the embodiment, nozzles 39 are shifted in both of the case in which the sheet 12 is nipped by the conveyance roller pair 59 but is not nipped by the discharge roller pair 44 (i.e., the case in which an image is recorded at the front end of the sheet 12) and the case in which the sheet 12 is nipped by the discharge roller pair 44 but is not nipped by the conveyance roller pair 59 (i.e., the case in which an image is recorded at the rear end of the sheet 12). Nozzles 39, however, may be shifted only in the case that an image is recorded at the front end of the sheet 12 or only in the case that an image is recorded at the rear end of the sheet 12.

Third Modified Embodiment

The controller 130 may change the number of shifts of nozzles 39 for the current recording process (i.e., the current pass) based on the ink amount jetted from the recording head 38 during the last recording process (i.e., the last pass).

Figure 8A:
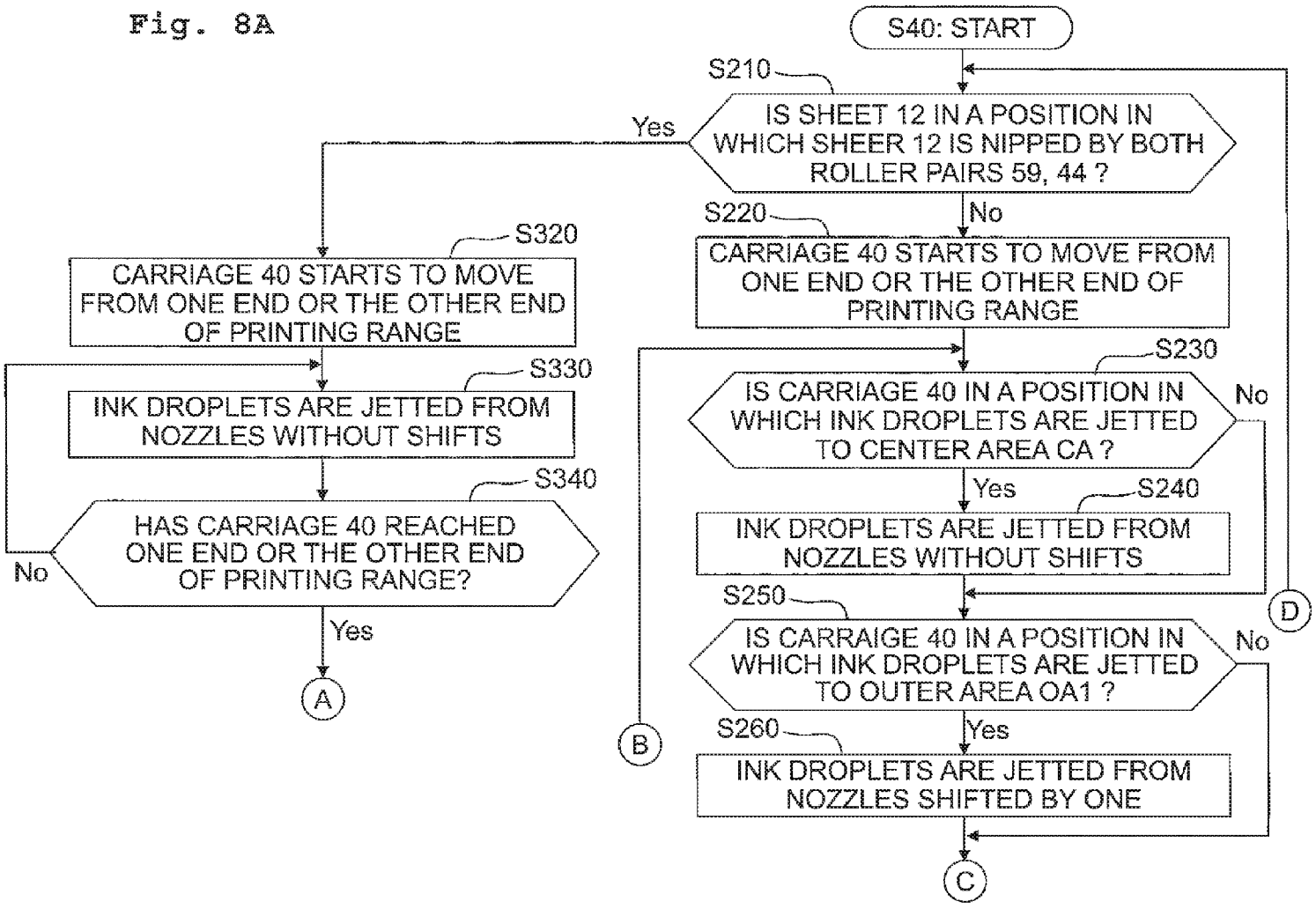
FIGS. 8A and 8B are flowcharts illustrating details of step S40 in FIG. 7.
Figure 8B:
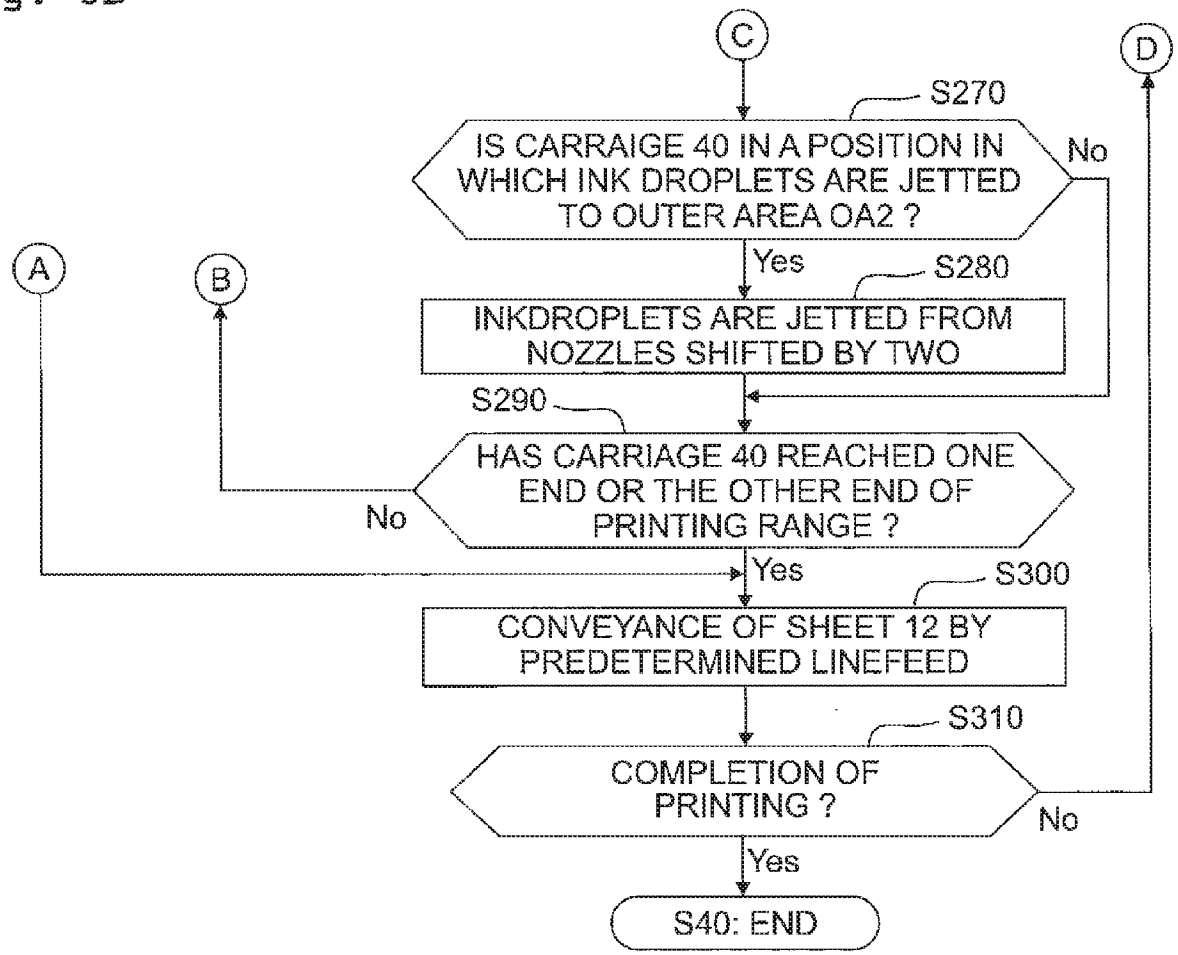

For example, at a timing between the step S210 and the step S220 in FIG. 8A, the controller 130 may calculate the ink amount jetted by the recording head 38 during the last recording process to compare the calculated ink amount and a predetermined threshold value. When the calculated ink amount is larger than the threshold value, the controller 130 may increase the number of shifts of nozzles 39 in subsequent steps S260 and S280 for the recording process. For example, the controller 130 may increase the number of shifts of nozzles 39 in the step S260 from "one" to "two", and the controller 130 may increase the number of shifts of nozzles 39 in the step S280 from "two" to "three".

Similarly, at a timing between the step S210 and the step S220 in FIG. 9A and at a timing between the step S210 and the step S420 in FIG. 9A, the controller 130 may calculate the ink amount jetted by the recording head 38 during the last recording process to compare the calculated ink amount and a predetermined threshold value. When the calculated ink amount is larger than the threshold value, the controller 130 may increase the number of shifts of nozzles 39 in subsequent steps S260, S280, S460, and S480 for the recording process.

Contrary to the above, for example, when the calculated ink amount is smaller than the threshold value, the controller 130 may reduce the number of shifts of nozzles 39 in subsequent steps for the recording process.

For example, at a timing between the step S210 and the step S220 in FIG. 8A, the controller 130 may calculate the ink amount jetted by the recording head 38 during the last recording process to compare the calculated ink amount and predetermined first and second threshold values. The first threshold value is greater than the second threshold value. When the calculated ink amount is greater than the first threshold value, the controller 130 may increase the number of shifts of nozzles 39 in subsequent steps S260 and S280 for the recording process. For example, the controller 130 may increase the number of shifts of nozzles 39 in the step S260 from "one" to "two", and the controller 130 may increase the number of shifts of nozzles 39 in the step S280 from "two" to "three". When the calculated ink amount is smaller than the second threshold value, the controller 130 may reduce the number of shifts of nozzles 39 in subsequent steps S260 and S280 for the recording process. For example, the controller 130 may reduce the number of shifts of nozzles 39 in the step S260 from "one" to "zero", and the controller 130 may reduce the number of shifts of nozzles 39 in the step S280 from "two" to "one". When the calculated ink amount is not more than the first threshold value and not less than the second threshold value, the controller 130 may not change the number of shifts of nozzles 39 in subsequent steps S260 and S280 for the recording process.

Similarly, at a timing between the step S210 and the step S220 in FIG. 9A and at a timing between the step S210 and the step S420 in FIG. 9A, the controller 130 may calculate the ink amount jetted by the recording head 38 during the last recording process to compare the calculated ink amount and the first and second threshold values. When the calculated ink amount is larger than the first threshold value, the controller 130 may increase the number of shifts of nozzles 39 in subsequent steps S260, S280, S460, and S480 for the recording process. When the calculated ink amount is smaller than the second threshold value, the controller 130 may reduce the number of shifts of nozzles 39 in subsequent steps S260, S280, S460, and S480 for the recording process. When the calculated ink amount is not more than the first threshold value and not less than the second threshold value, the controller 130 may not change the number of shifts of nozzles 39 in subsequent steps S260, S280, S460, and S480 for the recording process.

In the third modified embodiment, the number of shifts of nozzles 39 for the current pass is changed based on the ink amount jetted by the recording head 38 in the last pass. The number of shifts of nozzles 39, however, may be changed based on something other than the last pass.

For example, when an image is recorded by jetting ink droplets on a sheet 12, the number of shifts of nozzles 39 for the fourth pass may be determined based on the total of ink amounts which have been jetted to record the image on the sheet 12 during the first to third passes. Further, for example, the number of shifts of nozzles 39 for the seventh pass may be determined based on the total of ink amounts which have been jetted to record the image on the sheet 12 during the third to sixth passes. Further, for example, the number of shifts of nozzles 39 for the fifth pass may be determined based on the total of ink amounts which have been jetted to record the image on the sheet 12 during the first to third passes. Further, for example, the number of shifts of nozzles 39 for the fourth pass may be determined based on the average of ink amounts which have been jetted to record the image on the sheet 12 during the first to third passes.

Fourth Modified Embodiment

In the above embodiment, ribs 76 cooperate with downstream ends 81A of the contact members 81 to wave the sheet 12 along the right direction 8 and left direction 9. The mechanism causing the sheet 12 to have the waved shape along the right direction 8 and left direction 9, however, is not limited to the mechanism described in the above embodiment.

For example, only the ribs 76 may cause the sheet 12 to have the waved shape along the right direction 8 and left direction 9. Namely, contact members 81 may not be provided. In this case, parts, of the sheet 12, between adjacent ribs 76 sink under the weight of the ink landing on the sheet 12 or the self-weight of the sheet 12 in a state that the sheet 12 is supported by the ribs 76. Thus, the sheet 12 is made to have the waved shape along the right direction 8 and left direction 9.

What is claimed is:

1. An ink-jet recording apparatus configured to jet droplets of ink on a sheet, comprising:

a conveyance unit configured to convey the sheet in a conveyance direction while nipping the sheet;

a support part including ribs, which extend in the conveyance direction and are disposed at intervals in a width direction intersecting with the conveyance direction, and being configured to support the sheet conveyed in the conveyance direction;

a recording head disposed to face the support part, including nozzles disposed to be aligned in the conveyance direction, and being configured to jet ink droplets from the nozzles to the support part, a carriage carrying the recording head and being configured to move in the width direction;

a detecting unit configured to detect a position of the sheet conveyed; and a controller configured to control the conveyance unit to repeat conveyance of the sheet and stoppage of the conveyance of the sheet alternately and to control the recording head to perform recording in which ink droplets are jetted from the nozzles during movement of the carriage with the conveyance of the sheet being stopped, wherein, in a case that the sheet supported by the support part is in a position in which the sheet is nipped by the conveyance unit, the controller is configured to shift nozzles, from which ink droplets are jetted to a center area of an upper surface of the support part in the width direction, to an upstream or a downstream in the conveyance direction by a predetermined number relative to nozzles from which ink droplets are jetted to outer areas, of the upper surface of the support part, positioned outside the center area in the width direction.

2. The ink-jet recording apparatus according to claim 1, wherein the conveyance unit includes an upstream roller pair disposed on upstream of the support part in the conveyance direction, and in a case that the sheet supported by the support part is in a position in which the sheet is nipped by the upstream roller pair, the controller is configured to shift nozzles, from which ink droplets are jetted to the center area, upstream in the conveyance direction by a predetermined number relative to nozzles from which ink droplets are jetted to the outer areas.

3. The ink-jet recording apparatus according to claim 2, wherein the conveyance unit further includes a downstream roller pair disposed downstream of the support part in the conveyance direction, and the number of shifts of nozzles in a case that the sheet supported by the support part is in a position in which the sheet is nipped by the upstream roller pair and the downstream roller pair is determined, by the controller, to be different from the number of shifts of nozzles in a case that the sheet supported by the support part is in a position in which the sheet is nipped by one of the upstream roller pair and the downstream roller pair.

4. The ink-jet recording apparatus according to claim 3, wherein, in the case that the sheet supported by the support part is in the position in which the sheet is nipped by the upstream roller pair and the downstream roller pair, the controller is configured to shift no nozzles.

5. The ink-jet recording apparatus according to claim 2, further comprising contact parts positioned between the upstream roller pair and the nozzles in the conveyance direction and between the ribs disposed adjacently to each other in the width direction and configured to make contact with the sheet supported by the support part from above, thereby waving the sheet along the width direction in cooperation with the ribs.

6. The ink-jet recording apparatus according to claim 1, wherein the controller is configured to calculate an ink amount to be jetted by the recording head, and the controller is configured to change, based on the ink amount jetted by the recording head during the recording performed on the sheet, the number of shifts of nozzles for recording to be executed next on the sheet.

7. The ink-jet recording apparatus according to claim 1, wherein the outer areas include a plurality of kinds of outer areas disposed between the center area and both ends of the upper surface of the support part in the width direction, and the controller is configured to increase the number of shifts of nozzles as the recording head jets ink droplets to outer areas, of the plurality of kinds of outer areas, closer to both ends of the upper surface of the support part in the width direction.

8. An ink-jet recording apparatus configured to jet droplets of ink on a sheet, comprising:

a conveyance unit configured to convey the sheet in a conveyance direction while nipping the sheet;

a support part including ribs, which extend in the conveyance direction and are disposed at intervals in a width direction intersecting with the conveyance direction, and being configured to support the sheet conveyed in the conveyance direction;

a recording head disposed to face the support part, including nozzles disposed to be aligned in the conveyance direction, and being configured to jet ink droplets from the nozzles to the support part, a carriage carrying the recording head and being configured to move in the width direction;

a detecting unit configured to detect a position of the sheet conveyed; and a controller configured to control the conveyance unit to repeat conveyance of the sheet and stoppage of the conveyance of the sheet alternately and to control the recording head to perform recording in which ink droplets are jetted from the nozzles during movement of the carriage with the conveyance of the sheet being stopped, wherein, in a case that the sheet supported by the support part is in a position in which the sheet is nipped by the conveyance unit, the controller is configured to shift nozzles, from which ink droplets are jetted to a center area of an upper surface of the sheet in the width direction, to an upstream or a downstream in the conveyance direction by a predetermined number relative to nozzles from which ink droplets are jetted to outer areas, of the upper surface of the sheet, positioned outside the center area in the width direction.

* * * * *